United States Patent [19]

Bos

[11] Patent Number: 4,955,147

[45] Date of Patent: Sep. 11, 1990

[54] SHOE, SANDAL OR SIMILAR FOOTWEAR

[76] Inventor: Louis Bos, Hogewerf 108, 1082 NG Amsterdam, Netherlands

[21] Appl. No.: 285,760

[22] Filed: Dec. 16, 1988

[30] Foreign Application Priority Data

Dec. 29, 1987 [NL] Netherlands ..... 8703146

[51] Int. Cl.[5] ..... A43B 3/12

[52] U.S. Cl. ..... 36/11.5; 36/28

[58] Field of Search ..... 36/11.5, 28, 30 R, 43, 36/88, 93, 102, 7.5, 7.6, 8.1, 10, 25 R, 29, 30 A, 32 R, 44

[56] References Cited

U.S. PATENT DOCUMENTS

| | | | |
|---|---|---|---|
| Re. 18,237 | 10/1931 | Messler | 36/28 |
| 3,228,124 | 1/1966 | Schwarz | 36/11.5 |
| 3,323,233 | 6/1967 | Scholl | 36/11.5 |
| 3,739,501 | 6/1973 | Barrett | 36/11.5 |
| 4,101,704 | 7/1978 | Hiles | 36/30 R |
| 4,151,661 | 5/1979 | Namba | 36/30 R |
| 4,228,600 | 10/1980 | Krug | 36/30 R |
| 4,501,076 | 2/1985 | Dodds | 36/28 |
| 4,561,195 | 12/1985 | Onoda | 36/28 |
| 4,584,782 | 4/1986 | Thatcher | 36/11.5 |

FOREIGN PATENT DOCUMENTS

| | | | |
|---|---|---|---|
| 3347343 | 7/1985 | Fed. Rep. of Germany | 36/30 R |
| 25361 | 6/1986 | Japan | 36/11.5 |
| 689746 | 4/1953 | United Kingdom | 36/11.5 |

*Primary Examiner*—Werner H. Schroeder
*Assistant Examiner*—Diana L. Biefeld
*Attorney, Agent, or Firm*—Webb, Burden, Ziesenheim & Webb

[57] ABSTRACT

Footwear, such as a shoe (1) having a flat inner surface (5) and between said flat inner surface (5) and the instep a flat layer (6,12) of constant thickness for support of the foot, which flat layer (6,12) is of a highly springy elastic material with a high elastic recovery capacity, such as high density polyurethane foam. This flat layer requires the shoe to be made upon a last which allows sufficient space between instep and flat layer and accordingly is larger than is usual for a given size.

5 Claims, 1 Drawing Sheet

SHOE, SANDAL OR SIMILAR FOOTWEAR

The invention relates to a shoe provided with a sole having a wear layer, and with means for binding to the foot.

The hitherto known footwear, for example in the form of shoes or sandals, is designed in such a way that the sole and the upper are formed more or less according to a certain size and shape of foot. The surface of the sole can also be designed with a certain curve of elevations and recesses, in accordance with the support of the foot considered desirable while walking. It is also known to support the foot by means of a separate insole in the shoe.

The premise for this shaping of the sole of the shoe or of a separate insole is that the foot must be supported in such a way that the strain is taken off the bones or muscles of the feet. This premise can, however, be questioned. The idea that it is not necessarily an advantage to spare the foot muscles in such a way has recently been gaining ground. In any case, such an effect cannot be obtained in a natural situation, when walking barefoot.

On the other hand, it is far from ideal to walk barefoot on a hard surface. The question which thus arises is what surface would be ideal for walking on barefoot, avoiding the above-mentioned two extremes, i.e. full support of the foot, on the one hand, and a hard, flat surface, on the other. It is desirable to support the foot in such a way that the muscles of the foot are kept moving without being overstrained. The latter situation occurs, for example, when walking barefoot in loose, dry sand, where the foot muscles have to be used to their limit, which is very tiring. A more ideal surface for walking on is one which behaves like wet sand, in which an imprint of a certain limited depth is always made while walking. The foot muscles still have to be used, but the imprinted sand still gives a certain degree of support.

However, none of the hitherto known shoes or sandals exhibits such an effect. Nor can it be said that any of the hitherto known thin insoles made of elastic material support the foot in the way described above. For, the thin soles assume the shape of the sole of the shoe on which they are resting, so that with each step the foot is still resting on a preshaped more or less hard surface.

The object of the invention is therefore to produce footwear with which the foot is adequately supported, on the one hand, and the muscles are kept moving better in the desired way, on the other.

This object is achieved in that the side of the sole facing the foot is flat, and is provided with an also flat layer of highly springy elastic material which is not pre-shaped. During walking with this shoe the foot has to press down the layer of elastic material with each step, since said layer is entirely flat and is not pre-shaped. This naturally means that the foot muscles are working, yet as the layer of elastic material is depressed further the foot is given increasing support. On account of the high elastic recovery capacity of this layer, it is restored to its original shape once the weight is removed from the foot again, so that with the next step the process described above is repeated. This means that during walking support greatly resembling that obtained while walking on a wet sand surface as described above is obtained. An additional benefit obtained is that the flat layer can adapt in an ideal manner to any shape of foot, so that such a type of footwear is suitable for a wide range of people.

In order to be able to provide the desired degree of depression, the layer of springy material must not be too thin. A thickness of, say, at least 10 mm for an adult's shoe must be considered here.

The layer of elastic material is preferably plastic, but not all types of plastic are suitable. For example, foam rubber has too low an absorptive capacity and would be far too warm during wear.

It is preferable to use a polyurethane foam of high density as the material for the elastic layer.

The layer can be treated in the known manner, for example with a fungicide. The absorptive capacity is important. It is very high in high-density polyurethane foam.

It is pointed out that it is known per se to use such a polyurethane foam for an insole in a shoe.

However, the case in question concerns pre-shaped insoles for orthopaedic purposes. These soles are supplied by Professional Protective Technology Inc, and the material is known as P.P.T.

In the case of a shaped insole it is a matter of providing additional support for a part of the foot in a shoe made on an ordinary last.

In the case of the invention it is, however, a matter of creating a walking layer in the shoe, and the result of this is that a totally different, new last has to be used.

According to a first embodiment, the footwear can be a shoe with an upper fastened to the sole. In that case the height of the upper above the sole is equal to the sum of the thickness of the foot and the thickness of the elastic, unshaped layer. This means that the dimensions of the upper have to be synchronized with the thickness of this unshaped layer. For example, it is not possible to fit the unshaped elastic layer without further ado in a known shoe, because the space for the foot would then be too limited. In the shoe according to the invention another advantage obtained is that the contact face between the elastic layer and the flat top side of the sole is virtually flat and horizontal, so that during walking essentially no major horizontal force components occur between them, which could cause the layer to slip relative to the sole. This would probably be the case if the sole were pre-shaped.

According to a second embodiment, the footwear can be designed in the form of a sandal with an instep band fastened to the sole. In that case the height of the instep band above the sole is equal to the sum of the thickness of the foot and the thickness of the elastic unshaped layer.

The invention will be explained below with reference to a number of embodiments.

Figure 1:
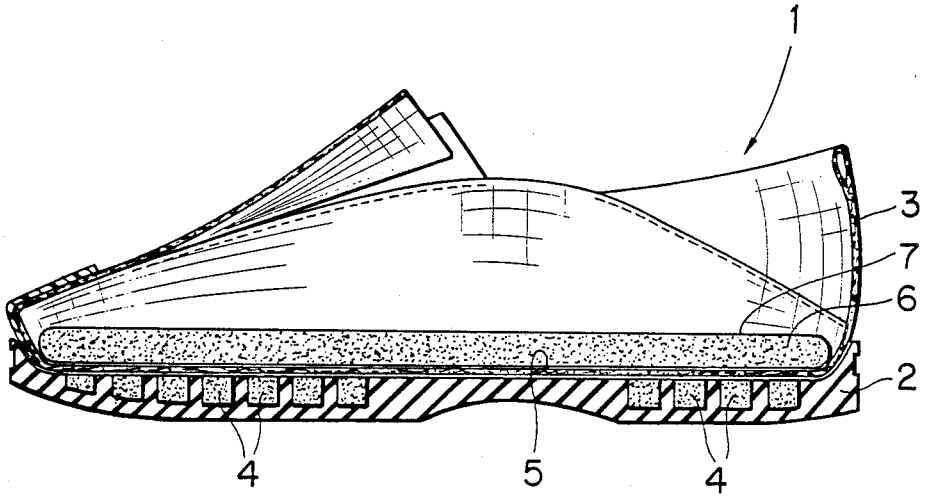
FIG. 1 shows a shoe according to the invention.

The shoe 1 shown in FIG. 1 comprises a sole 2 and an upper 3. The sole 2 can be provided with air-filled cavities 4 or with a springy material to increase comfort.

According to the invention, the top side 5 of the sole 2 is made flat. This flat top side 5 has on it a layer 6 of elastic material of high elastic recovery capacity, for example polyurethane foam.

This layer 6 is of uniform thickness, so that the top side 7 thereof is also flat when no weight is on it.

The height of the upper 3 above the top side 5 of the sole 2 is equal to the sum of the thickness of the foot and the thickness of the layer 6.

Figure 2:
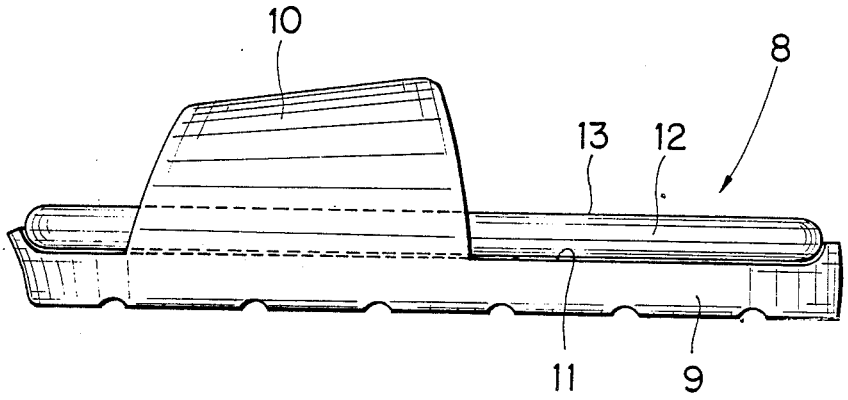
FIG. 2 shows a sandal according to the invention.

FIG. 2 shows a sandal 8 according to the invention. It also comprises a sole 9 and a band 10 running over the instep of the foot.

The top side 11 of the sandal 8 is flat. On the top side is a layer 12 of material of high elastic recovery capacity. This layer 12 is of uniform thickness, so that the top face 13 of said layer is also flat when no weight is on it.

I claim:

1. Footwear provided with a sole having a wear layer, and with means for binding to the foot, characterized in that the side of the sole facing the foot is flat, and is provided with an also flat layer of highly springy elastic material, said highly springy elastic material being characterized by a high elastic recovery capacity such that said layer of said highly springy elastic material provides increasing support as said layer is depressed further by the weight of said foot and wherein said layer of said highly springy elastic material instantaneously returns to a flat layer upon removal of the weight of said foot wherein said flat layer of said highly springy elastic material is further characterized by not being pre-shaped along a vertical plane to conform to the plantar surface of said foot.

2. Footwear according to claim 1, characterized in that the layer is plastic.

3. Footwear according to claim 2, characterized in that the layer is a polyurethane foam.

4. Footwear according to claim 1 wherein said means for binding to the foot comprises an upper fastened to the sole, characterized in that the height of the upper above the sole is equal to the sum of the thickness of the foot and the thickness of the elastic, unshaped layer.

5. Footwear according to claim 1 wherein said means for binding to the foot comprises an instep band fastened to the sole, characterized in that the height of the instep band above the sole is equal to the sum of the thickness of the foot and the thickness of the elastic unshaped layer.

* * * * *